US009279267B2

(12) United States Patent
Petrello et al.

(10) Patent No.: US 9,279,267 B2
(45) Date of Patent: Mar. 8, 2016

(54) SELF-ELEVATING MAST EMPLOYING DRAW WORKS

(71) Applicant: Nabors Drilling International Limited, Hamilton (BM)

(72) Inventors: Anthony Petrello, Houston, TX (US); Padira Reddy, Richmond, TX (US); Ashish Gupta, Houston, TX (US); Sean M. Bailey, Willis, TX (US)

(73) Assignee: NABORS DRILLING INTERNATIONAL LIMITED, Hamilton (BM)

( * ) Notice: Subject to any disclaimer, the term of this patent is extended or adjusted under 35 U.S.C. 154(b) by 0 days.

(21) Appl. No.: 14/581,499

(22) Filed: Dec. 23, 2014

(65) Prior Publication Data

US 2015/0107165 A1 Apr. 23, 2015

Related U.S. Application Data

(63) Continuation of application No. 13/799,635, filed on Mar. 13, 2013, now Pat. No. 8,935,901.

(51) Int. Cl.

| | |
|---|---|
| ***E04H 12/34*** | (2006.01) |
| ***E21B 15/00*** | (2006.01) |
| ***E21B 19/00*** | (2006.01) |
| ***E04B 1/343*** | (2006.01) |
| ***E04B 1/35*** | (2006.01) |

(52) U.S. Cl.

CPC ..... *E04H 12/344* (2013.01); *E04B 1/34305* (2013.01); *E04B 1/3522* (2013.01); *E21B 15/00* (2013.01); *E21B 19/00* (2013.01); *E04B 2001/3588* (2013.01)

(58) Field of Classification Search

CPC ..... E21B 15/00; E21B 7/02; E21B 19/02; E21B 19/00; E04H 12/34; E04H 12/344; E04B 1/3522; E04B 1/34305; E04B 2001/3588

USPC ..... 52/111, 123.1, 745.03

See application file for complete search history.

(56) References Cited

U.S. PATENT DOCUMENTS

| | | | | | |
|---|---|---|---|---|---|
| 3,185,265 | A | * | 5/1965 | White | 52/111 |
| 3,747,695 | A | * | 7/1973 | Branham | 173/151 |
| 3,828,513 | A | * | 8/1974 | Vanderklaauw | 52/745.04 |
| 4,375,241 | A | * | 3/1983 | Gallon | 173/151 |
| 4,434,971 | A | * | 3/1984 | Cordrey | 254/273 |
| 4,757,592 | A | * | 7/1988 | Reed | 29/429 |
| 4,836,300 | A | * | 6/1989 | Reed | 175/57 |
| 4,885,893 | A | * | 12/1989 | Wasterval et al. | 52/745.18 |
| 5,247,776 | A | * | 9/1993 | Tamayo | 52/745.17 |

(Continued)

*Primary Examiner* — Basil Katcheves
*Assistant Examiner* — Joshua Ihezie
(74) *Attorney, Agent, or Firm* — Haynes and Boone LLP

(57) ABSTRACT

A system comprising a support structure having a plurality of vertically extending members arranged to define a mast channel, the support structure attached to a platform having a rig floor and the support structure positioned above an opening in the rig floor; a first mast section that is attached to the support structure; a second mast section that is attached to the support structure and the first mast section; and a third mast section; wherein the system has a first arrangement in which the third mast section is located below the rig floor in a vertical position and is vertically spaced from the second mast; and wherein the system has a second arrangement in which the third mast section is attached to the second mast section and at least a portion of the third mast extends within the opening of the rig floor.

20 Claims, 13 Drawing Sheets

(56) References Cited

U.S. PATENT DOCUMENTS

| | | | | |
|---|---|---|---|---|
| 5,342,020 | A * | 8/1994 | Stone | 254/269 |
| 5,423,158 | A * | 6/1995 | Vora | 52/745.17 |
| 5,490,364 | A * | 2/1996 | Desai et al. | 52/637 |
| 6,301,841 | B1 * | 10/2001 | Rhebergen et al. | 52/123.1 |
| 7,461,831 | B2 * | 12/2008 | Mosley | 254/277 |
| 8,353,132 | B1 * | 1/2013 | Vogt et al. | 52/123.1 |
| 8,516,751 | B2 * | 8/2013 | Konduc et al. | 52/112 |
| 8,556,003 | B2 * | 10/2013 | Souchek | 175/162 |
| 8,646,240 | B1 * | 2/2014 | Patrick et al. | 52/651.05 |
| 2003/0172599 | A1 * | 9/2003 | Frink | 52/116 |
| 2007/0017704 | A1 * | 1/2007 | Belik | 175/52 |
| 2009/0000218 | A1 * | 1/2009 | Lee et al. | 52/123.1 |
| 2009/0188677 | A1 * | 7/2009 | Ditta et al. | 166/382 |
| 2011/0103922 | A1 * | 5/2011 | Belik | 414/22.58 |
| 2011/0114386 | A1 * | 5/2011 | Souchek | 175/52 |
| 2012/0304553 | A1 * | 12/2012 | Konduc et al. | 52/112 |
| 2014/0090333 | A1 * | 4/2014 | Vogt | 52/651.05 |

* cited by examiner

SELF-ELEVATING MAST EMPLOYING DRAW WORKS

CROSS-REFERENCE TO RELATED APPLICATION

This application is a continuation of U.S. application Ser. No. 13/799,635, filed Mar. 13, 2013, now allowed, the entire disclosure of which is hereby incorporated herein by express reference thereto.

BACKGROUND OF THE DISCLOSURE

The present disclosure relates in general to drilling rigs, and in particular, to assembling a drilling mast using a self-elevating mast employing draw works.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
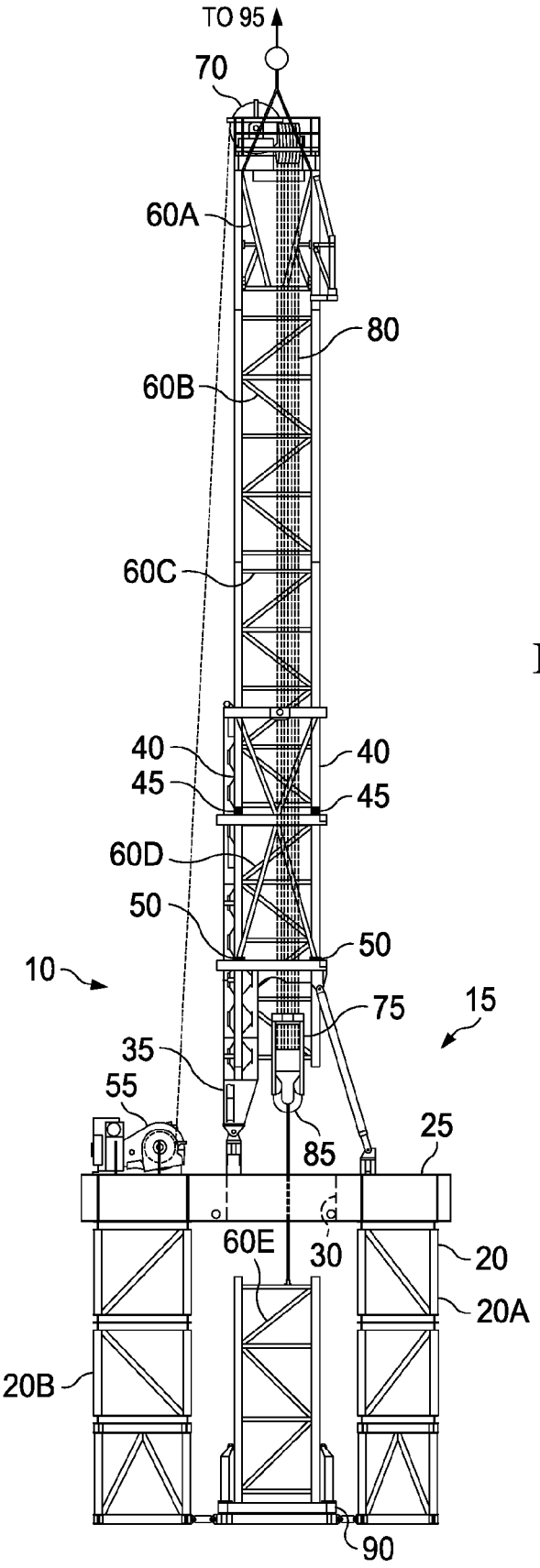
FIG. 1 is an elevational view of an apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Referring to FIG. 1, illustrated is an elevational view of apparatus 10. The apparatus 10 may be used during the construction of a land-based drilling rig 15. However, in several exemplary embodiments, instead of a land-based drilling rig, the apparatus 10 may be used in association with any type of drilling rig, such as a jack-up rig, a semisubmersible rig, a drill ship, a coil tubing rig, or a casing drilling rig, among others. In one embodiment, the drilling rig 15 includes a platform 20 with a platform floor or a rig floor 25. The platform 20 is positioned above a wellbore (not shown), which can be a wellbore or a planned wellbore, and in most embodiments this positioning occurs before the assembly operation described herein is carried out. In one embodiment, an opening 30 is formed in the rig floor 25. In some embodiments, the opening 30 has an axis that is coaxial with an axis of the wellbore. In another embodiment, the opening 30 has an axis parallel with or "at least substantially" (e.g., within 10 degrees) parallel with the axis of the wellbore. In another embodiment, the opening 30 is generally above the wellbore. In one embodiment, the drilling rig 15 includes a support structure 35 having a plurality of vertically extending members 40. In one embodiment, the support structure 35 has an upper portion, a middle portion, and a lower portion. In an exemplary embodiment, the support structure 35 has four members arranged to define an inner perimeter of a mast channel. In one embodiment, each of the plurality of the members has two fasteners, including without limitation holding pins, vertically spaced along a longitudinal axis of each member, with an upper holding pin 45 located near an upper member portion, which corresponds to the upper portion of the support structure and a lower holding pin 50 located near a middle member portion, which corresponds to the middle portion of the support structure. It should be noted that, while upper and lower holding pins are noted here and throughout in various exemplary embodiments, any suitable fastener may be selected. In one embodiment, the support structure 35 is generally coaxial with the axis of the wellbore and or the opening 30. In one embodiment, the support structure 35 is attached to the platform 20 or the rig floor 25 or both using a fastener, which in one embodiment includes a bolt and pin system. In various other embodiments, the support structure 35 is attached to the platform 20 or the rig floor 25 or both using a nut and bolt system, latches or screws. In one embodiment, the support structure 35 extends vertically from the rig floor 25. In one embodiment, the lower portion of the support structure 35 is attached to the platform 20. In one embodiment, the drilling rig 15 also includes a draw works 55 attached to the platform 20 or the rig floor 25 or both. In another embodiment, the draw works 55 may be located below the platform 20 or the rig floor 25, including being located on the ground. In another embodiment, any large hoist may be used in place of the draw works 55. In one embodiment, the drilling rig 15 includes a mast 60 having multiple mast sections 60*a*, 60*b*, 60*c*, 60*d*, and 60*e*. En one embodiment, the mast sections 60*a*, 60*b*, 60*c*, 60*d*,and 60*e* are temporarily attached together to form the mast 60. In one embodiment, the mast sections 60*a*,60*b*, 60*c*, 60*d*, and 60*e* are temporarily attached together to form the mast 60 using a fastener, such as a bolt and pin system, wherein an opening on a lower section of the mast section 60*a* and an opening on an upper section of the mast section 60*b* are attached using a bolt or pin or both (not shown). In some embodiments, the mast 60 extends through the opening 30. In one embodiment, the mast 60 is coupled to the support structure 35 using the lower holding pins 50, the upper holding pins 45, or both. In an exemplary embodiment, a large set of pulleys or a crown block 70 is connected to the mast section 60*a*, which is the upper most mast section of the mast 60. In one embodiment, a large set of sheaves or a traveling block 75 connects to the crown block 70 using a drilling line 80. In one embodiment, the drilling line 80 can be a rope, wire rope, or cable. In one embodiment, the crown block 70 is positioned on the mast section 60*a* to allow for the crown block 70 and the drilling line 80 to travel vertically through the past channel. In one embodiment, the drilling line 80 connects the traveling block 75 and the crown block 70, and is wound in the draw works 55. In an exemplary embodiment, as the draw works 55 winds or shortens the drilling line 80, the crown block 70 and an attached hook 85 are raised in an upward direction towards the crown block 70 and away from the rig floor 25. In an exemplary embodiment, as the draw works 55 lengthens or unwinds the drilling line 80, the crown block 70 and the hook 85 are lowered in a downward direction towards the rig floor 25 and away from the crown block 70.

In one embodiment, the platform 20 includes a row of sub boxes 20*a* and 20*b*. A mast cart 90 may be positioned under the opening 30, for example in a channel created by a width separating the row of sub boxes 20*a* and 20*b*. In an exemplary embodiment, the mast cart 90 sequentially accommodates each of the mast sections 60*b*, 60*c*, 60*d* and 60*e*. That is, each of the mast sections 60*b*, 60*c*, 60*d*, and 60*e* may be arranged on the mast cart 90 in a vertical position on the mast cart 90. In some embodiments, each mast section is secured to the mast cart 90. In an exemplary embodiment and as shown in FIG. 1, the mast sections 60*a*, 60*b*, 60*c*, 60*d*, and 60*e* have an maximum exterior width and depth to be accommodated within the mast channel of the support structure 35. In an exemplary embodiment, the mast sections 60*a*, 60*b*, 60*c*, 60*d*, and 60*e* are sized to prevent the support structure 35 from impeding the vertical movement of the mast sections 60*a*, 60*b*, 60*c*, 60*d*, and 60*e*, with the upper holding pins 45 and the lower holding pins 50 used to secure the mast 60 at a vertical location along the support structure 35.

Figure 2A:
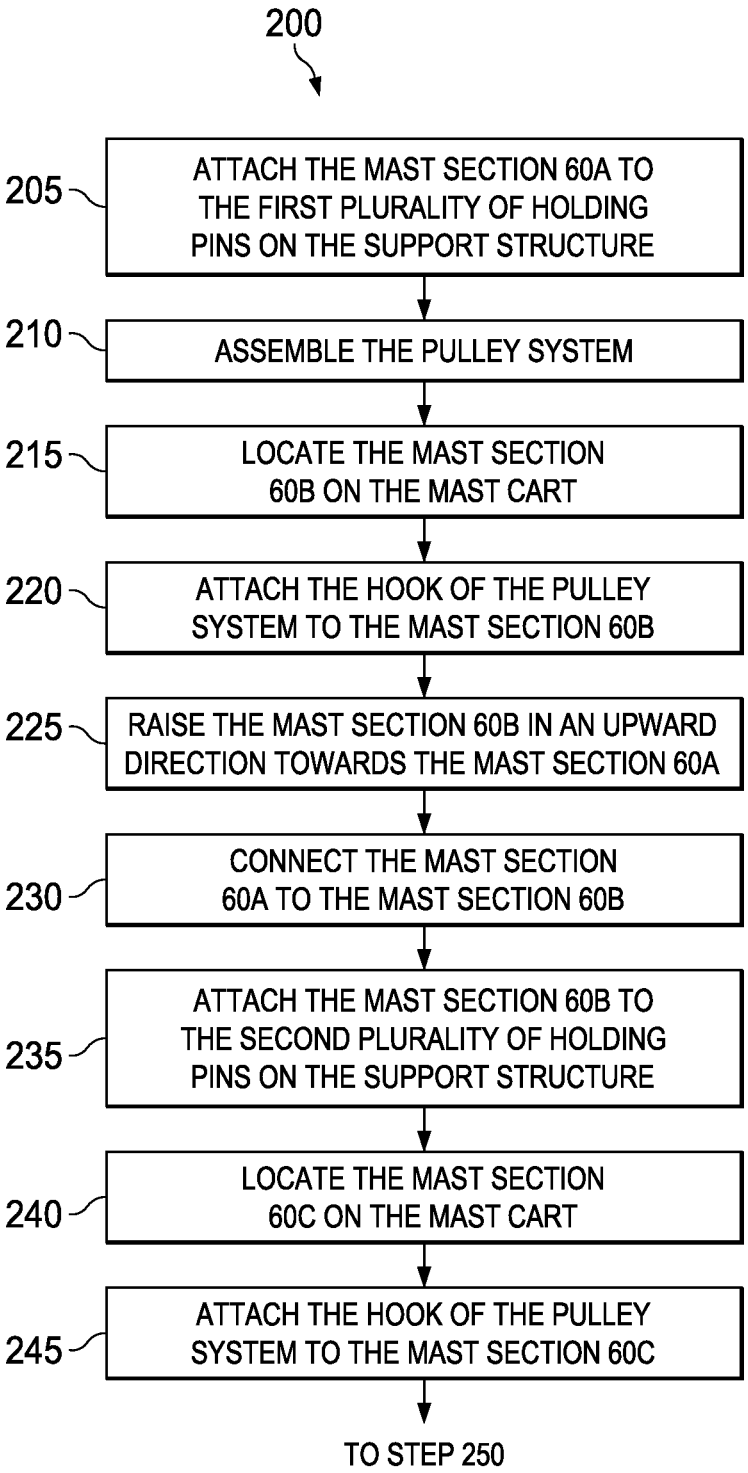
FIGS. 2A-2C are flow chart illustrations that together describe a method of operating the apparatus of FIG. 1, according to an exemplary embodiment.
Figure 2B:
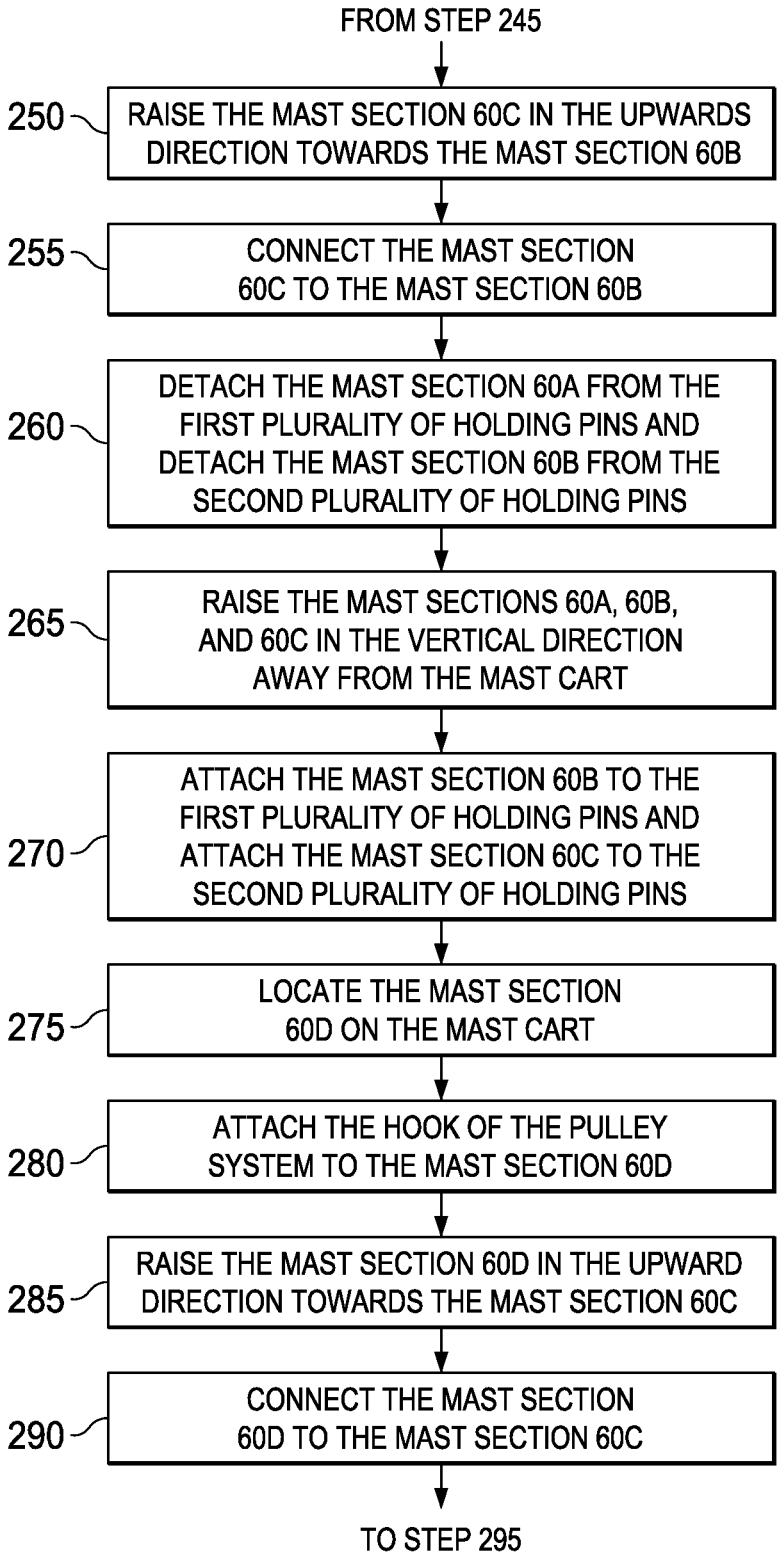
Figure 2C:
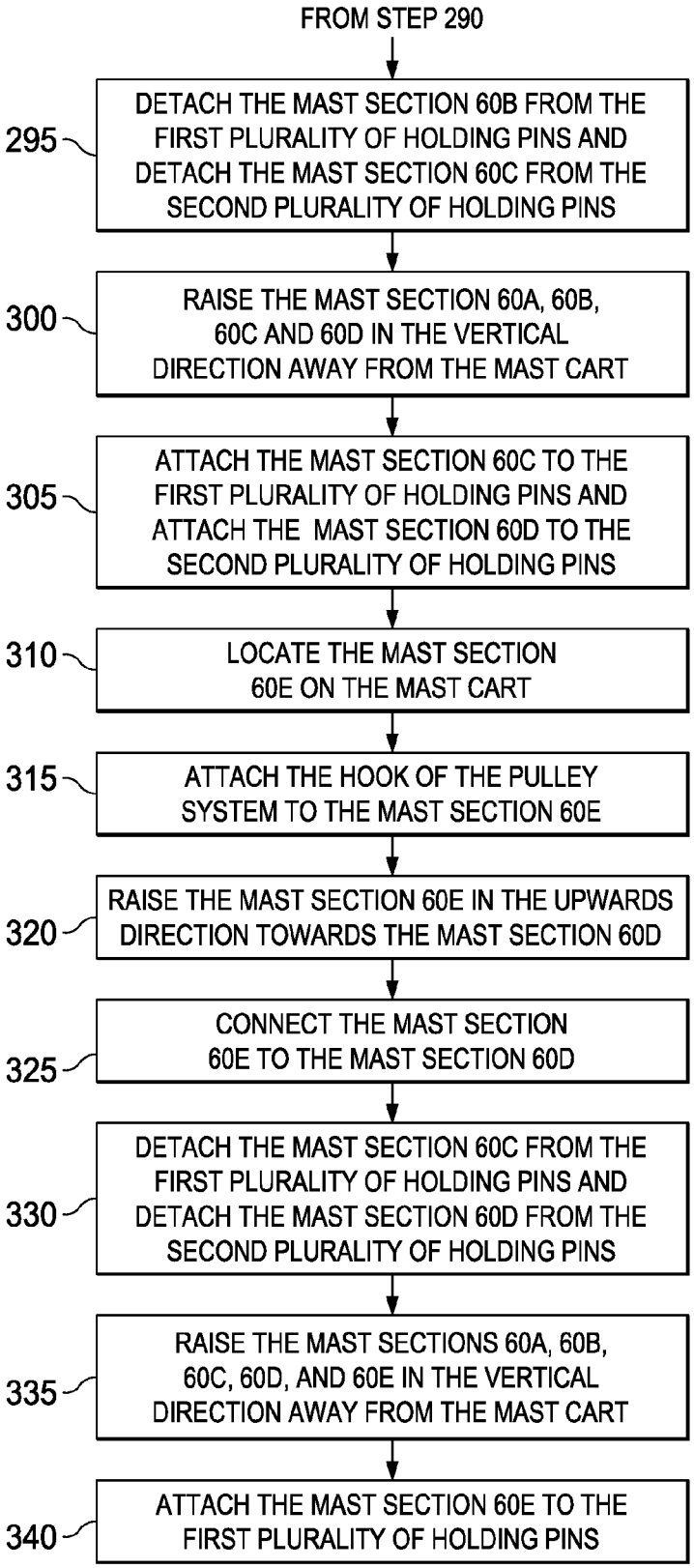

In an exemplary embodiment, as illustrated in FIGS. 2A, 2B, and 2C with continuing reference to FIG. 1, a method of operating the apparatus 10 is generally referred to by the reference numeral 200. In an exemplary embodiment, the execution of the method 200 results in the construction of the mast 60 of the drilling rig 15.

Figure 3:
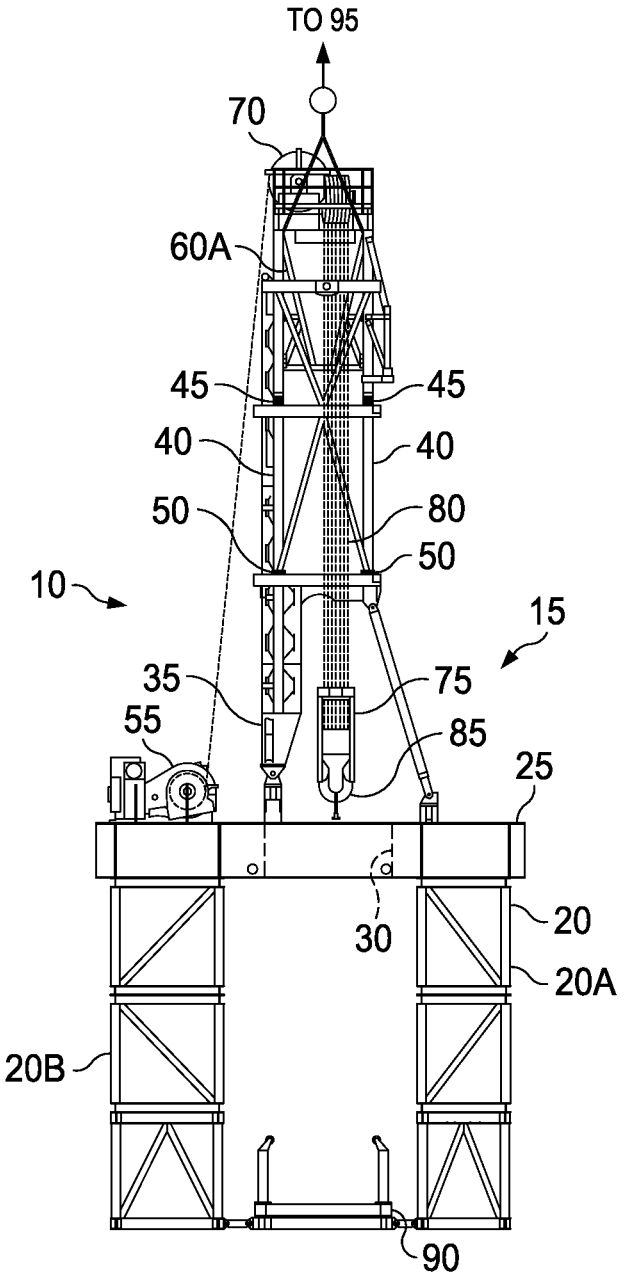
FIGS. 3-11 are views similar to that of FIG. 1, but depict the apparatus of FIG. 1 in different operational modes, according to one or more aspects of the present disclosure.

At step 205 and as shown in FIG. 3, the mast section 60*a* is attached to the support structure 35 using the plurality of holding pins 45. In one embodiment, the mast section 60*a* is placed on the support structure 35 using an overhead support, such as a crane 95 or lift (not shown). That is the crane 95 is located above the mast section 60*a* and may connect to (or otherwise be operably coupled to) the mast section 60*a* to raise the mast section 60*a*, along with anything attached thereto. In one embodiment, the mast section 60*a* is located within the mast channel of the support structure 35. In an exemplary embodiment, and as shown in FIG. 3, at least a portion of the mast section 60*a* extends outside of the mast channel of the supporting structure 35.

At step 210 and as shown in FIG. 3, a pulley system 100 is assembled. In an exemplary embodiment, the pulley system 100 includes the crown block 70, the drilling line 80, the traveling block 75, the hook 85, and the draw works 55. In an exemplary embodiment, to assemble the pulley system 100, the crown block 70 is attached to the mast section 60*a* with the drilling line 80, which is attached to the draw works 55, strung through the plurality of pulleys that include the crown block 70 and the pulleys that include the traveling block 75. In an exemplary embodiment, the crown block 70 is stationary after it is attached to the mast section 60*a*, while the traveling block 75 moves vertically in the mast channel. In an exemplary embodiment, the traveling block 75 moves in an upward direction towards the crown block 70 and away from the mast cart 90, and in a downward direction towards the mast cart 90 and away from the crown block 70. In an exemplary embodiment, the crown block 70 and the traveling block 75 act as pivot points within the pulley system 100. The traveling block 75 moves vertically in the mast channel due to the winding of the mast works 55. In an exemplary embodiment, winding the draw works shortens the length of drilling line 80 and causes the traveling block 75 to move in the upward direction, while unwinding of the draw works lengthens the length of the drilling line 80 and causes the traveling block 75 to move in the downward direction.

Figure 4:
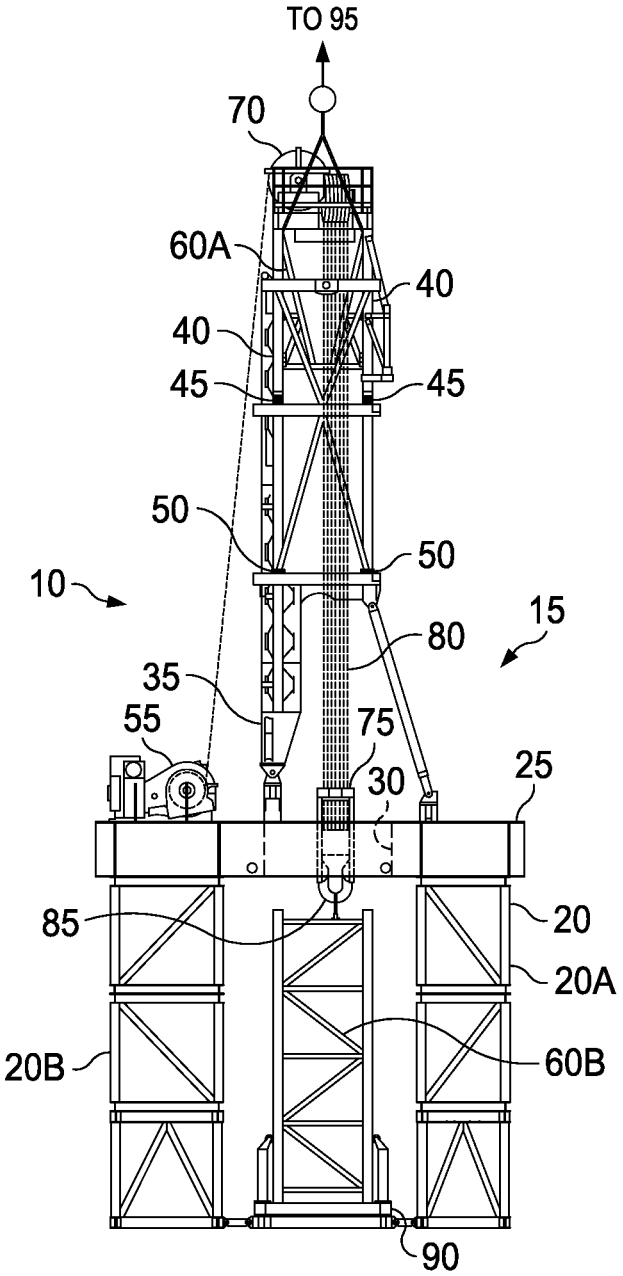

At step 215 and as shown in FIG. 4, the mast section 60*b* is located or disposed on the mast cart 90. In one embodiment, the mast section 60*b* is arranged on the mast cart 90 in a vertical position. That is a longitudinal axis of the mast section 60*b* is parallel with, at least substantially parallel with, or coaxial to a longitudinal axis of the mast section 60*a*. In one embodiment, the longitudinal axis of the mast section 60*b* is parallel with, at least substantially parallel with, or coaxial to a longitudinal axis of the opening 30. In one embodiment, the mast section 60*b* is located below the opening 30 so that the mast section 60*b* may pass through the opening 30. In one embodiment, the mast section 60*b* is located below the opening of the mast section 60*a*.

At step 220, the hook 85 is attached to the mast section 60*b*. In one embodiment, the hook 85 is attached to a padeye located on the mast section 60*b*. In one embodiment, the hook 85 and a sling are used to attach to the mast section 60*b*. In one embodiment, the hook 85 is operably coupled to the mast section 60*b*.

Figure 5:
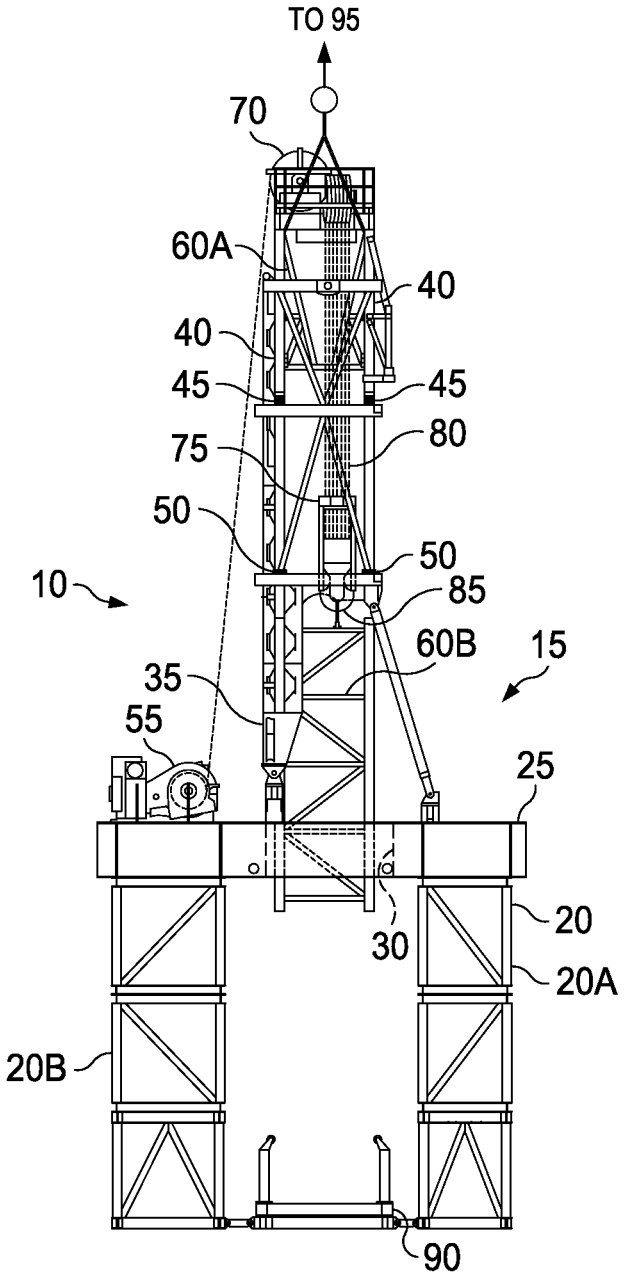

At step 225 and as shown in FIG. 5, the mast section 60*b* is raised in the upward direction using the pulley system 100 towards the mast section 60*a*. In one embodiment, the draw works 55 winds the drilling line 80 to raise the traveling block 75, the hook 80, and the mast section 60*b* towards the mast section 60*a*. In one embodiment, the drilling line 80, the traveling block 75, the hook 80, and the mast section 60*b* pass through the opening 30. In one embodiment, the pulley system 100 raises the mast section 60*b* to a position directly below the mast section 60*a* so as to couple the mast section 60*a* and the mast section 60*b*.

Figure 6:
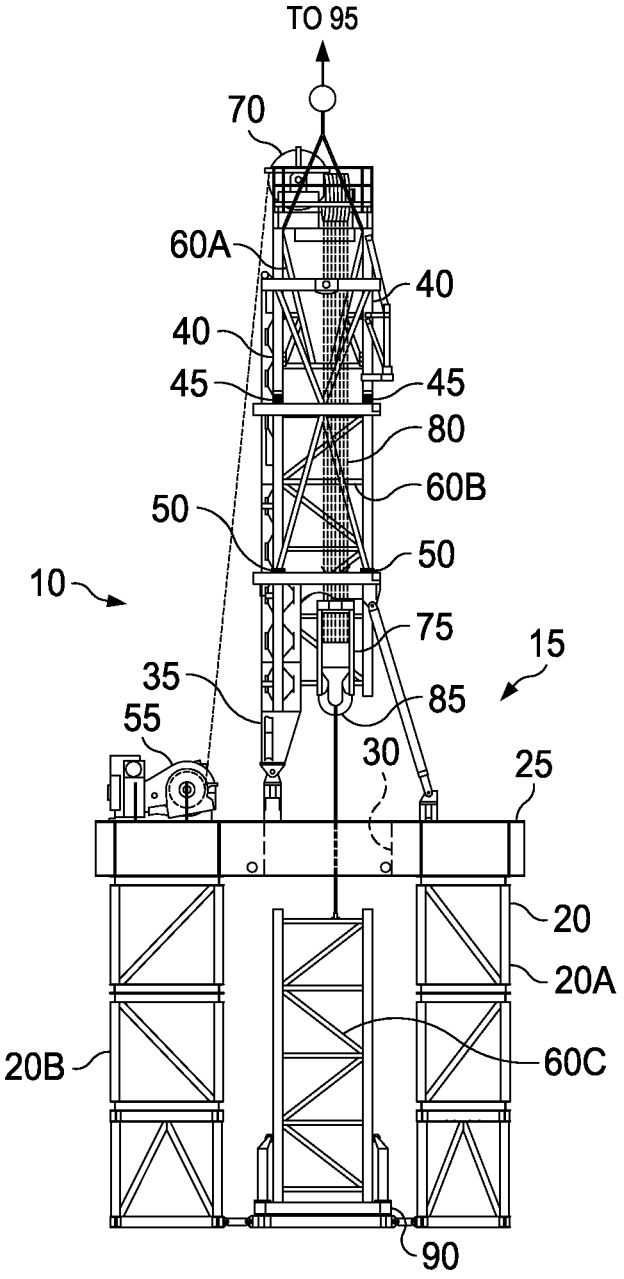

At step 230 and as shown in FIG. 6, the mast section 60*b* is connected to the mast section 60*a*. In one embodiment, an upper portion of the mast section 60*b* is connected to a lower portion of the mast section 60*a* using a pin and bolt system. In another embodiment, the mast section 60*b* is connected to the mast section 60*a* using latches, screws or nuts and bolts.

At step 235, the mast section 60*b* is attached to the support structure 35 using the plurality of lower holding pins 50. That is, the mast section 60*a* is attached to the support structure 35 using the plurality of upper holding pins 45, the mast section 60*b* is attached to the support structure 35 using the plurality of lower holding pins 50, and the mast section 60*a* is connected to the mast section 60*b*.

At step 240, the mast section 60*c* is located or disposed on the mast cart 90. In one embodiment, the mast section 60*c* is arranged on the mast cart 90 in a similar manner to that which the mast section 60*b* is arranged on the mast cart 90 at the step 215.

At step 245, the hook 85 is attached to the mast section 60*c*. In one embodiment, the hook 85 is attached to the mast section 60*c* is a manner similar to that which the mast section 60*b* is attached to the hook at the step 220.

Figure 7:
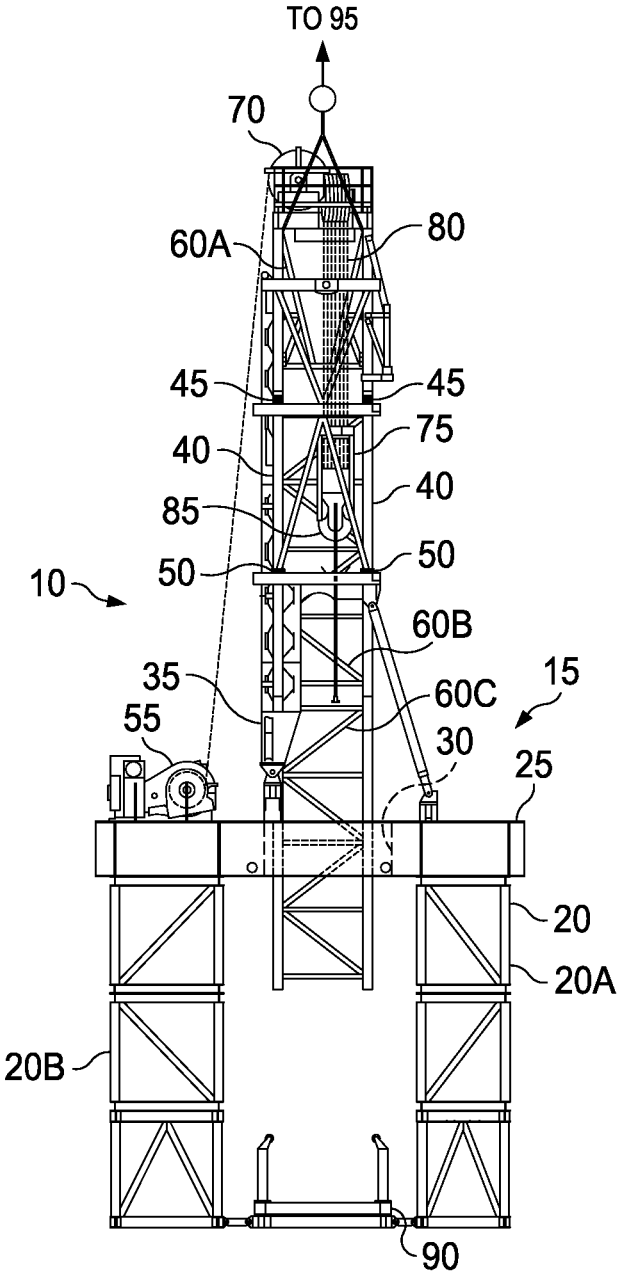

At step 250 and as shown in FIG. 7, the mast section 60*c* is raised in the upward direction using the pulley system 100 towards the mast section 60*b*. In one embodiment, the mast section 60*c* is raised in the upward direction in a manner similar to that which the mast section 60*b* is raised in the upward direction at the step 225.

At step 255, the mast section 60*c* is connected to the mast section 60*b*. In one embodiment, the mast section 60*c* is connected to the mast section 60*b* in a manner similar to that which the mast section 60*b* is connected to the mast section 60*a* in the step 230.

At step 260, the mast section 60*a* is detached from the plurality of upper holding pins 45 and the mast section 60*b* is detached from the lower holding pins 50 while using an overhead support, such as the crane 95, to support the mast section 60*a*, the mast section 60*b*, and the mast section 60*c*.

Figure 8:
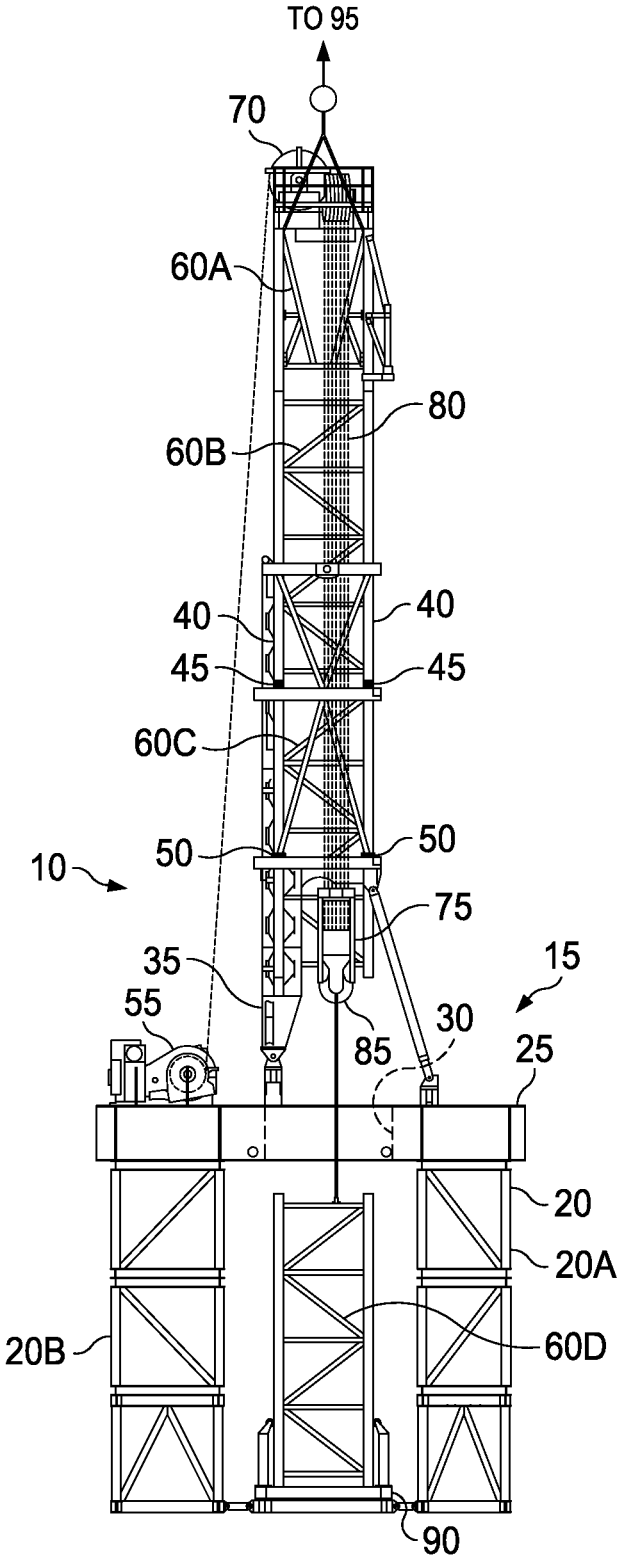

At step 265 and as shown in FIG. 8, the mast section 60*a*, the mast section 60*b*, and the mast section 60*c* are raised in a vertical direction away from the mast cart 90 so that the mast section 60*b* is in a position to be connected to the plurality of upper holding pins 45 and the mast section 60*c* may be connected to the plurality of lower holding pins 50.

At step 270, the mast section 60*b* is attached to the plurality of upper holding pins 45 and the mast section 60*c* is attached to the plurality of lower holding pins 50.

At step 275, the mast section 60*d* is located or disposed on the mast cart 90. In one embodiment, the mast section 60*d* is arranged on the mast cart 90 in a similar manner to that which the mast section 60*b* is arranged on the mast cart 90 at the step 215.

At step 280, the hook 85 is attached to the mast section 60*d*. In one embodiment, the hook 85 is attached to the mast section 60*d* is a manner similar to that which the hook 85 is attached to the mast section 60*b* at the step 220.

Figure 9:
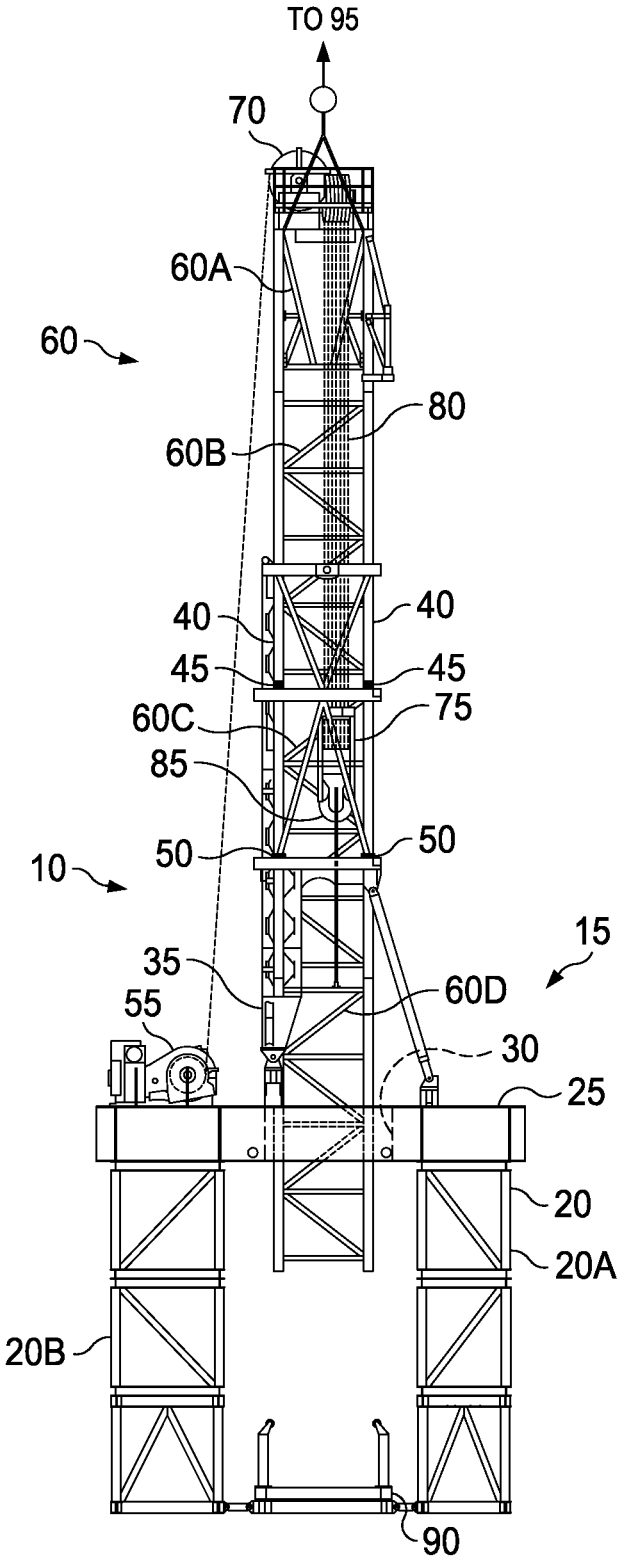

At step 285 and as shown in FIG. 9, the mast section 60*d* is raised in the upward direction using the pulley system 100 towards the mast section 60*c*. In one embodiment, the mast section 60*d* is raised in the upward direction in a manner similar to that which the mast section 60*b* is raised in the upward direction at the step 225.

At step 290, the mast section 60*d* is connected to the mast section 60*c*. In one embodiment, the mast section 60*d* is connected to the mast section 60*c* in a manner similar to that which the mast section 60*b* is connected to the mast section 60*a* in the step 230.

At step 295, the mast section 60*b* is detached from the plurality of upper holding pins 45 and the mast section 60*c* is detached front the lower holding pins 50 while using an overhead support, such as the crane 95, to support the mast section 60*a*, the mast section 60*b*, the mast section 60*c*, and the mast section 60*d*.

At step 300 and as shown in FIG. 1, the mast section 60*a*, the mast section 60*b*, the mast section 60*c*, and the mast section 60*d* are raised in the upward direction away from the mast cart 90 so that the mast section 60*c* may be connected to the plurality of upper holding pins 45 and the mast section 60*d* may be connected to the plurality of lower holding pins 50.

At step 305, the mast section 60*c* is attached to the plurality of upper holding pins 45 and the mast section 60*d* is attached to the lower holding pins 50.

At step 310, the mast section 60*e* is located or disposed on the mast cart 90. In one embodiment, the mast section 60*e* is arranged on the mast cart 90 in a similar manner to that which the mast section 60*b* is arranged on the mast cart 90 at the step 215.

At step 315, the hook 85 is attached to the mast section 60*e*. In one embodiment, the hook 85 is attached to the mast section 60*e* is a manner similar to that which the hook 85 is attached to the mast section 60*b* at the step 220.

Figure 10:
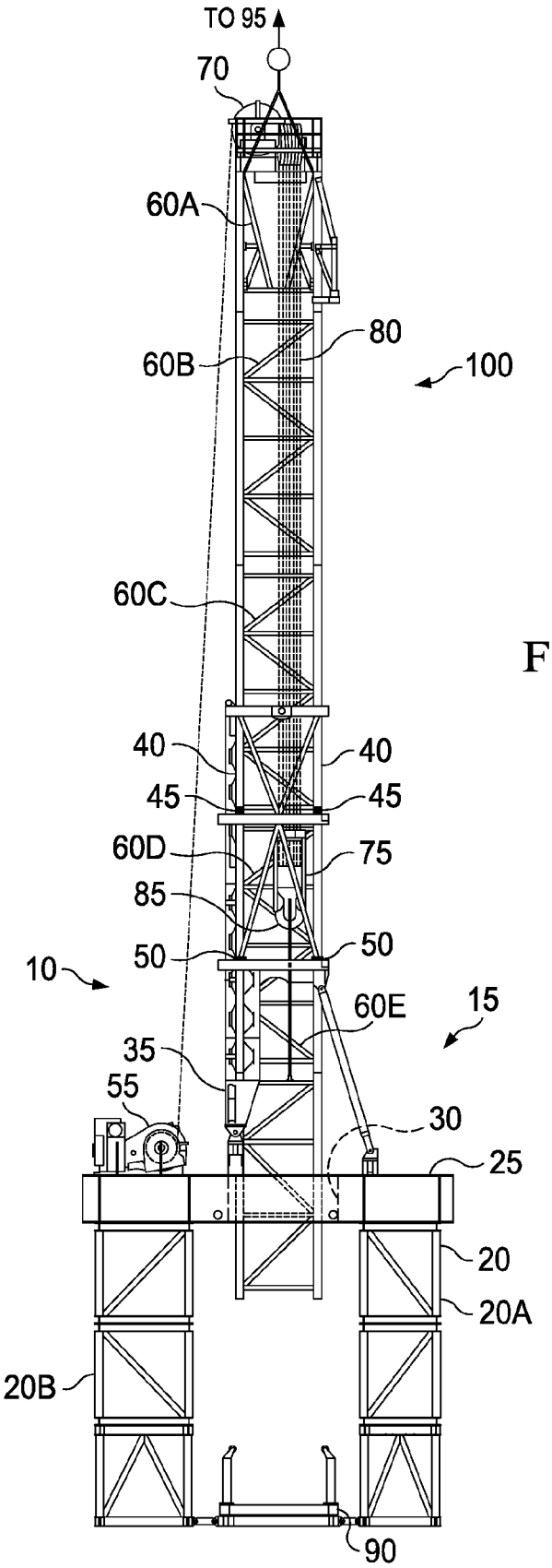

At step 320 and as shown in FIG. 10, the mast section 60*e* is raised in the upward direction using the pulley system 100. In one embodiment, the mast section 60*e* is raised in the upward direction in a manner similar to that which the mast section 60*b* is raised in the upward direction at the step 225.

At step 325, the mast section 60*e* is connected to the mast section 60*d*. In one embodiment, the mast section 60*e* is connected to the mast section 60*d* in a manner similar to that which the mast section 60*b* is connected to the mast section 60*a* in the step 230.

Figure 11:
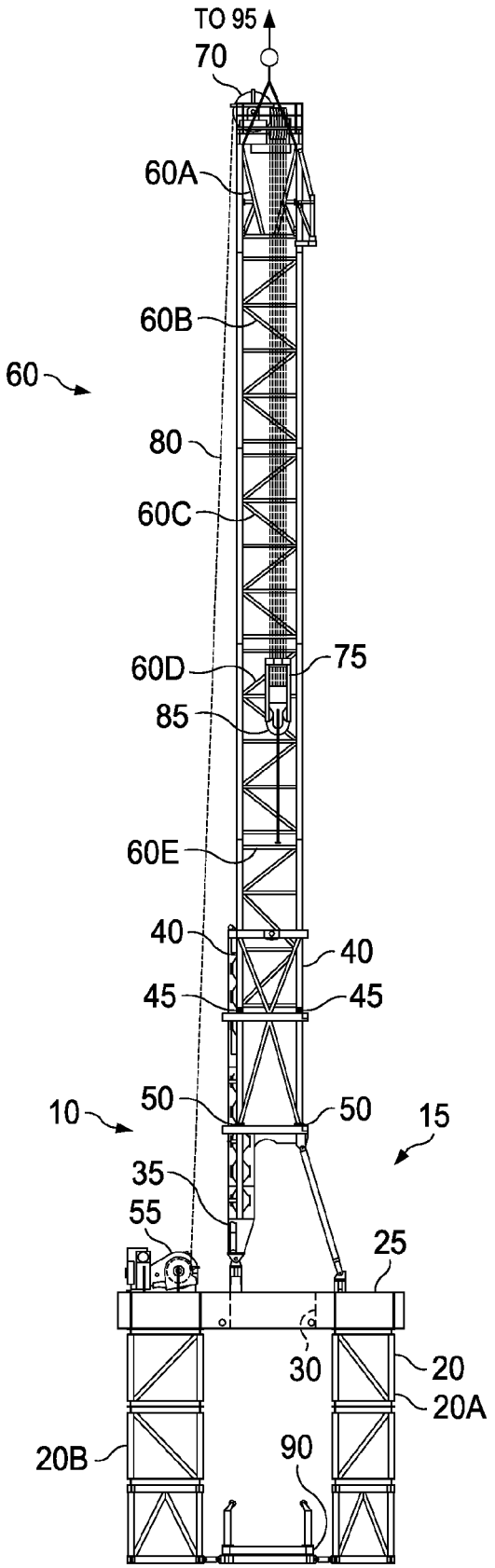

At step 330, the mast section 60*c* is detached from the plurality of upper holding pins 45 and the mast section 60*d* is detached from the plurality of lower holding pins while using an overhead support, such as the crane 95 to support the mast sections 60*a*, 60*b*, 60*c*, 60*d*, and 60*e*. At step 335 and as shown in FIG. 11, the mast section 60*a*, the mast section 60*b*, the mast section 60*c*, the mast section 60*d*, and the mast section 60*e* are raised in a vertical direction away from the mast cart 90 so that the mast section 60*e* may be connected to the plurality of upper holding pins 45.

At step 340, the mast section 60*e* is attached to the plurality of upper holding pins 45. Once the mast section 60*e* is attached to the plurality of upper holding pins 45, the mast 60 is constructed.

In an alternative embodiment, the mast cart 90 is not required at the steps 215, 240, 275, and 310. The mast sections 60*b*, 60*c*, 60*d*, and 60*e* may be located on any surface below the opening 30 at the steps 215, 240, 275, and 310, respectively.

The present disclosure also describes an apparatus including a support structure having a plurality of vertically extending members arranged to define an inner perimeter of a mast channel, the support structure attached to a platform having a platform floor and the support structure positioned above an opening in the platform floor; a first mast section configured to be attached, using a first plurality of holding pins located on the support structure, to the support structure, at least a portion of the first mast section located within the mast channel, the first mast section having a lower first mast portion and an upper first mast portion, the first mast section configured to be attached to a pulley system; wherein the pulley system includes a hoist attached to the platform; a line attached to the hoist and operably coupled to a pulley, the pulley attached to the upper first mast portion; and a hook coupled to the line, the line and the hook located within the mast channel; and a second mast section configured to be attached, using a second plurality of holding pins located on the support structure, to the support structure; wherein, the second mast section is configured to be raised, using the pulley system, from a first location below the platform to a second location directly below the first mast section; wherein an upper second mast portion of the second mast section is configured to be attached to the lower first mast portion; wherein the first mast section is configured to detach from the support structure while the first mast section is supported by an overhead source located above the first support structure and connected to the first mast section; wherein the second mast section is configured to detach from the support structure while the second mast section is supported by the overhead source; and wherein the first mast section and the second mast section are configured to be raised by the overhead source to a third location where the second mast section can attach to the support structure using the first plurality of holding pins. In one aspect, the lower first mast portion connects to the upper second mast portion using a pin. In one aspect, the hoist is a draw works. In one aspect, the pulley is a crown block. In one aspect, the opening is located above a wellbore. In one aspect, the platform floor is a rig floor. In one aspect, the opening is larger than the second mast section. In one aspect, the second mast section is spaced vertically from the rig floor when in the first location. In one aspect, the second mast section has a longitudinal axis that is parallel or substantially parallel with a longitudinal axis of the opening. In one aspect, the second mast has a longitudinal axis that is coaxial to a longitudinal axis of the opening.

The present disclosure also describes a system that includes a support structure having a plurality of vertically extending members arranged to define an inner perimeter of a mast channel, the support structure attached to a platform having a rig floor and the support structure positioned above an opening in the rig floor; a first mast section that is attached to the support structure, at least a portion of the first mast section located within the mast channel; a second mast section that is attached to the support structure and the first mast section; and a third mast section; wherein the system has a first arrangement in which the third mast section is located below the rig floor in a vertical position and is vertically spaced from the second mast section; and wherein the system has a second arrangement in which the third mast section is attached to the second mast section and at least a portion of the third mast section extends within the opening of the rig floor. In one aspect, the opening is larger than each of the second mast section and the third mast section. In one aspect, the first mast section is attached to the support structure at a first location using a first plurality of pins located on the support structure; and wherein the second mast section is attached to the support structure using a second plurality of pins located on the support structure. In one aspect, each of the fist mast section and the second mast section is adapted to be detached from the support structure while being supported by an overhead source that is located above the first support structure and that is connected to the first mast section; the first mast section, the second mast section, and the third mast section are adapted to be raised, using the overhead source and relative to the support structure, to move the first mast section from the first location to a second location relative to the support structure; and wherein the second mast section is adapted to be attached to the support structure using the first plurality of holding pins while at the second location. In one aspect, in the first arrangement, the rig floor is vertically spaced from the third mast section. In one aspect, the first mast section is attached to the second mast section using a pin. In one aspect, the first mast section is attached to a pulley system including a hoist attached to the platform; a line attached to the hoist and operably coupled to a pulley, the pulley attached to the first mast section; and a hook coupled to the line, the line and the hook located within the mast channel. In one aspect, each of the second mast section and the third mast. section is adapted to be attached to the hook. In one aspect, the opening is located above a wellbore. In one aspect, the third mast section has a longitudinal axis that is parallel or substantially parallel with a longitudinal axis of the opening when the system is in the first arrangement. In one aspect, the third mast has a longitudinal axis that is coaxial to a longitudinal axis of the opening When the system is in the first arrangement.

In several exemplary embodiments, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, and/or combined, at least in part, with one or more of the other elements and teachings of the various illustrative embodiments.

Any spatial references such as, for example, "upper," "lower," "above," "below," "between," "bottom," "vertical," "horizontal," "angular" "upwards," "downwards," "side-to-side," "left-to-right," "right-to-left," "top-to-bottom," "bottom-to-top," "top," "bottom," "bottom-up," "top-down," etc., are for the purpose of illustration only and do riot limit the specific orientation or location of the structure described above.

In several exemplary embodiments, while different steps, processes, and procedures are described as appearing as distinct acts, one or more of the steps, one or more of the processes, and/or one or more of the procedures may also be performed in different orders, simultaneously and/or sequentially. In several exemplary embodiments, the steps, processes and/or procedures may be merged into one or more steps, processes and/or procedures.

In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several exemplary embodiments have been described in detail above, the embodiments described are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes and/or substitutions are intended to be included within the scope of this disclosure as defined in the following claims. In the claims, any means-plus-function clauses are intended to cover the structures described herein as performing the recited function and not only structural equivalents, but also equivalent structures.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure, and that they may make various changes. substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. §112(f) for any limitations of any of the claims herein, except for those in which the claim expressly uses the word "means" together with an associated function.

What is claimed is:

1. An apparatus comprising;

a support structure having a plurality of vertically extending members arranged to define an inner perimeter of a mast channel, the support structure attached to a platform having a platform floor and the support structure positioned above an opening in the platform floor;

a first plurality of holding pins located on the support structure;

a second plurality of holding pins located on the support structure;

a pulley system comprising:

a hoist attached to the platform;

a line attached to the hoist and operably coupled to a pulley, the pulley attached to an upper first mast portion; and a hook coupled to the line, the line and the hook located within the mast channel;

a first mast section attached, using the first plurality of holding pins, to the support structure, at least a portion of the first mast section located within the mast channel, the first mast section having a lower first mast portion and an upper first mast portion, the first mast section attached to the pulley system;

and a second mast section attached, using the second plurality of holding, to the support structure;

wherein the second mast section is configured to be raised, using the pulley system, from a first location below the platform to a second location directly below the first mast section;

wherein an upper second mast portion of the second mast section is configured to be attached to the lower first mast portion;

wherein the first mast section is configured to detach from the support structure while the first mast section is supported by an overhead source located above the first support structure and connected to the first mast section;

wherein the second mast section is configured to detach from the support structure while the second mast section is supported by the overhead source; and wherein the first mast section and the second mast section are configured to be raised by the overhead source to a third location where the second mast section can attach to the support structure using the first plurality of holding pins.

2. The apparatus of claim 1, wherein the lower first mast portion connects to the upper second mast portion using a pin.

3. The apparatus of claim 1, wherein the hoist is a draw works.

4. The apparatus of claim 1, wherein the pulley is a crown block.

5. The apparatus of claim 1, wherein the opening is located above a wellbore.

6. The apparatus of claim 1, wherein the platform floor is a rig floor.

7. The apparatus of claim 1, wherein the opening is larger than the second mast section.

8. The apparatus of claim 1, wherein the second mast section is spaced vertically from the platform floor when in the first location.

9. The apparatus of claim 1, wherein the second mast section has a longitudinal axis that is parallel or substantially parallel with a longitudinal axis of the opening.

10. The apparatus of claim 1, where the second mast section has a longitudinal axis that is coaxial to a longitudinal axis of the opening.

11. A system comprising:

a support structure having a plurality of vertically extending members arranged to define an inner perimeter of a mast channel, the support structure attached to a platform having a rig floor and the support structure positioned above an opening in the rig floor;

a first mast section that is directly attached to the support structure, at least a portion of the first mast section located within the mast channel;

a second mast section that is attached to the support structure and the first mast section; and a third mast section;

wherein the system has a first arrangement in which the third mast section is located below the rig floor in a vertical position and is vertically spaced from the second mast section;

wherein the system has a second arrangement in which the third mast section is attached to the second mast section and at least a portion of the third mast section extends within the opening of the rig floor; and wherein the first mast section is attached to a pulley system comprising:

a hoist attached to the platform;

a line attached to the hoist and operably coupled to a pulley, the pulley attached to the first mast section; and a hook coupled to the line, the line and the hook located within the mast channel.

12. The system of claim 11, wherein the opening is larger than each of the second mast section and the third mast section.

13. The system of claim 11, wherein the first mast section is attached to the support structure at a first location using a first plurality of pins located on the support structure; and wherein the second mast section is attached to the support structure using a second plurality of pins located on the support structure.

14. The system of claim 13, wherein each of the first mast section and the second mast section is adapted to be detached from the support structure while being supported by an overhead source that is located above the support structure and that is connected to the first mast section;

wherein the first mast section, the second mast section, and the third mast section are adapted to be raised, using the overhead source and relative to the support structure, to move the first mast section from the first location to a second location relative to the support structure; and wherein the second mast section is adapted to be attached to the support structure using the first plurality of holding pins while at the second location.

15. The system of claim 11, wherein in the first arrangement, the rig floor is vertically spaced from the third mast section.

16. The system of claim 11, wherein the first mast section is attached to the second mast section using a pin.

17. The system of claim 11, wherein each of the second mast section and the third mast section is adapted to be attached to the hook.

18. The system of claim 11, wherein the opening is located above a wellbore.

19. The system of claim 11, wherein the third mast section has a longitudinal axis that is parallel or substantially parallel with a longitudinal axis of the opening when the system is in the first arrangement.

20. The system of claim 11, where the third mast has a longitudinal axis that is coaxial to a longitudinal axis of the opening when the system is in the first arrangement.

* * * * *